United States Patent [19]

Jewell et al.

[11] 4,167,191

[45] Sep. 11, 1979

[54] TOBACCO DRYING PROCESS

[75] Inventors: John N. Jewell; Ardath B. Canon, both of Louisville; Richard P. Newton, Jr., Middletown, all of Ky.

[73] Assignee: Brown & Williamson Tobacco Corporation, Louisville, Ky.

[21] Appl. No.: 837,331

[22] Filed: Sep. 27, 1977

[51] Int. Cl.[2] ..... A24B 3/18

[52] U.S. Cl. ..... 131/140 R; 131/140 P

[58] Field of Search ..... 131/120, 121, 133–138, 131/140 R, 140 P, 400, 17; 426/445–451

[56] References Cited

U.S. PATENT DOCUMENTS

| | | | |
|---|---|---|---|
| 3,524,452 | 8/1970 | Moser et al. | 131/140 P |
| 3,599,645 | 8/1971 | Johnson | 131/140 P |
| 3,785,384 | 11/1971 | Sylvester | 131/121 |
| 3,881,498 | 5/1975 | Wochnowski | 131/140 P |
| 3,957,063 | 5/1976 | Wochnowski | 131/140 P |
| 4,040,431 | 8/1977 | Ashworth et al. | 131/140 P |

*Primary Examiner*—Robert W. Michell
*Assistant Examiner*—V. Millin
*Attorney, Agent, or Firm*—William J. Mason

[57] ABSTRACT

The disclosure is of a process for reducing the moisture content of expanded tobacco while minimizing yield losses and reducing particle lamination while maintaining filling power. The process comprises drying the expanded tobacco at a temperature within the range of from about 250° F. to about 650° F. in the presence of an absolute humidity at a level above that which will provide a wet-bulb temperature of at least about 150° F.

21 Claims, 3 Drawing Figures

TOBACCO DRYING PROCESS

BACKGROUND OF THE INVENTION

1. Field of the Invention

The invention relates to processes for drying tobacco and, more particularly, relates to a process for reducing the moisture content of expanded tobacco.

2. Brief Description of the Prior Art

In the manufacture of cigarettes and like articles, it is the usual practice to reduce tobacco, the term being used herein to include both lamina and stems, to a particle size appropriate for preparing cigarettes. The moisture content of the tobacco is generally increased prior to this size reduction to minimize shattering and provide a material of more uniform particle size. In order to permit subsequent processing, e.g., formation of the cigarette rod, it is necessary to reduce the moisture content of the tobacco to a level below that at which size reduction is conducted.

In general, the prior art discloses drying of cut tobacco from an initial moisture content, usually about 16 to 35 percent in the case of lamina and about 20 to about 60 percent in the case of stem, to a moisture range of about 12–15 percent by passing the tobacco through hot air under time and temperature conditions adequate to effect the desired moisture reduction. The prior art discloses various apparatus and procedures for effecting this drying. For example, U.S. Pat. No. 3,357,436 discloses drying cut tobacco, having an initial moisture content of 16–35 percent, to a final moisture content of approximately 13 percent by exposing the tobacco to air heated to a temperature of 150°–600° F., the air having a water content of at least 10 percent by weight.

In recent years it has become a widespread practice in the tobacco industry to expand or "puff" cut tobacco prior to its incorporation into cigarettes. Expansion processes produce tobacco having a reduced density or increased filling power, i.e., an increase in the volume occupied by a given weight of tobacco, permitting improved quality and economics and reduced "tar" and nicotine deliveries. Numerous techniques are described in the prior art for effecting tobacco expansion. In general, tobacco expansion is achieved by impregnating tobacco with water, an organic liquid, carbon dioxide, ammonia, or some combination thereof, followed by subjecting the impregnated tobacco to increased temperature and/or reduced pressure conditions. In prior art techniques for then drying the expanded tobacco, much of the advantages attributable to the expansion is lost or reduced due to shrinkage which occurs during the drying process. A process by which expanded tobacco could be dried to a desired level, while minimizing any concomitant loss in filling power due to shrinkage, is of substantial benefit.

By the method of the present invention, one may reduce the moisture content of expanded tobacco to a desired level, while minimizing loss in filling power.

SUMMARY OF THE INVENTION

The invention comprises a method of reducing the moisture content of an expanded tobacco, which comprises: heating the expanded tobacco in a gas, said gas having an initial temperature within the range of from about 250° F. to about 650° F., in the presence of an absolute humidity at a level above that which will provide a wet-bulb temperature reading of at least about 150° F.

The term "expanded tobacco," as used throughout the specification and claims, means processed tobacco, including reconstituted tobacco, which has been treated to increase its volume and green tobacco. The maximum expansion level for tobacco occurs when it is in its green, freshly harvested (turgor) condition. As it is cured and processed, the moisture content decreases and so does its volume or "expansion." Expanded tobacco is then also tobacco subjected to a "reexpansion" of volume.

The term "absolute humidity" as used herein means the absolute water content in the air surrounding the tobacco subjected to the method of the present invention.

A wet-bulb temperature is achieved by placing a wet cotton wick over a thermometer bulb and placing it in an air-stream. As the water from the wick evaporates, the wick cools down until the rate of heat transferred to the wick by the measured environment equals the rate of heat loss created by the water evaporating from the wick. This equilibrium point is called the wet-bulb temperature and, in conjunction with a normal temperature reading and a psychrometric table, the relative and absolute humidity of the drying air can be determined. Wet-bulb temperature has greater physical significance than does absolute humidity or percent water vapor in describing a drying media, since in most dryers the solids dry at or near the wet-bulb temperature.

DETAILED DESCRIPTION OF THE INVENTION

Figure 1:
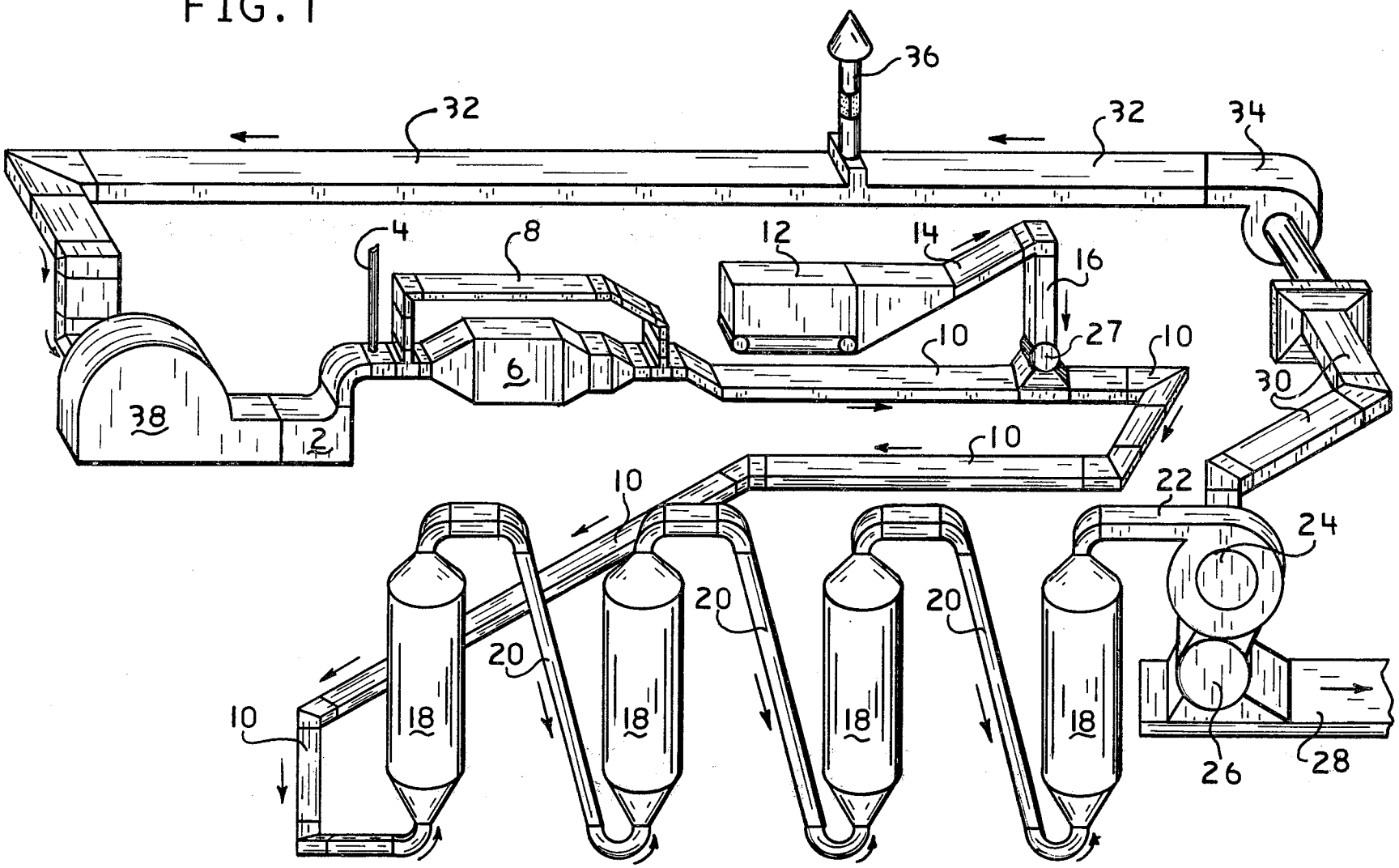
FIG. 1 is a schematic flow diagram for a preferred embodiment process of the invention.

The process of the invention may be carried out according to the embodiment scheme shown in the drawing of FIG. 1. As shown in FIG. 1, air is carried by closed duct 2 past steam entry port 4, through which steam or a mixture of steam and air may be injected into the airstream. The air flows through a closed heater 6 and the heated air flows into conduit 10. A heater bypass duct 8 may be automatically or manually valved to bypass air around the heater 6, providing a means of regulating the temperature of the air entering conduit 10. The capacity of heater 6 and the design of bypass duct 8 is advantageously such that the temperature of the air in conduit 10 is maintained within the range of from about 250° F. to about 650° F. Water vapor introduced through entry port 4 is advantageously adjusted to maintain a high humidity in the conduit 10; i.e., a humidity level which will provide a wet-bulb temperature reading in conduit 10 of at least 150° F. As will be noted from FIG. 2, an increase in filling power begins to be observed at this temperature. Desirably, the wet-bulb temperature is maintained as high as possible, e.g., at least about 205° F. up to the maximum of 212° F. With some equipment, these higher temperatures are not practical. Thus, normal operating temperatures will be about 180° F., or greater.

Expanded tobacco is conveyed from supply hopper 12 by supply conveyor 14 to vertical pipe 16 into airlock 27 into conduit 10. Other types of tobacco supply means may, of course, be used to bring the expanded tobacco into intimate admixture with the hot, high humidity air within conduit 10. The air entrained expanded tobacco is then carried through a plurality of drying chambers 18 and connecting ducts 20. The chambers 18 are a dryer means, to effect drying of the air entrained expanded tobacco to the desired moisture level. The chambers 18 may be selected to have a capacity sufficient to maintain the desired temperature range of the airflow. The number of chambers 18 may be selected to provide any desired residence time for any degree of drying desired. In each chamber 18, the tobacco is conveyed upwardly, the velocity of the air being substantially lower than in the ducts of the system. The chamber is so proportioned in relation to the velocity of airflow that the airflow in the chamber is insufficient to overcome the force of gravity on denser portions of the tobacco, so that such denser portions will lose their initial upward velocity before reaching the top of the chamber and will sink back in the outer part of the chamber and execute a circulatory motion in the chamber until their density has become less. These denser portions of tobacco may be the result of wetness of the tobacco or physical matting or lamination padding. In the case of drying lamina which is padded, this circulatory motion tends to depad the particles resulting in an additional fill value improvement.

Expanded tobacco and air existing from the last chamber 18 is carried through duct 22 to a separator 24. The separator 24 is preferably a tangential separator. It will be appreciated, however, that other types of separators may be used. Tobacco exits from separator 24 through airlock 26 and is conveyed to the next tobacco processing stage by conveyor 28. The separated exhaust air is recycled through ducts 30 and 32. A fan 34 is interposed within the ductwork to motivate the air. Also, an exhaust port 36 is positioned in the duct 32 to exhaust excess air from the system. Air carried through duct 32 reenters duct 2 through a final separator 38, which removes any dust from the airstream. Preferably, separator 38 is a rotoclone type of separator, which also assists in motivating the air. In FIG. 1, the arrows show the flow direction of the expanded tobacco and/or air. Inasmuch as the amount of moisture removed from a particular tobacco, types of tobacco, blends of tobacco and form thereof will vary, the operating parameters of the process of the invention will vary, accordingly, in producing a uniform and constant moisture content of tobacco discharged from the system. Two important factors which control the operation of the system of FIG. 1 are:

(a) the hold time of the tobacco within the system, and (b) ratio of volume of airflow to weight of tobacco being discharged.

The quantity of heat required for drying the tobacco will be dependent upon the rate at which the tobacco is fed through the system and upon its initial moisture content. An increase in either the said rate or content will tend to produce a reduction of air temperature in the conduit 10 and chambers 18, so that the heat input in heater 6 will of necessity have to be increased. Similarly, a reduction in feed rate or moisture content will produce a reduction in the heat input. Accordingly, the heat input will be so proportioned, depending upon the conditions, that the final moisture content of the tobacco will be maintained constant.

Expanded tobacco to be dried by the process of the invention will vary in moisture content. The moisture content of cut tobacco will, accordingly, spread over the outside limits of roughly 18 to 90 percent for lamina and 30 to 90 percent for tobacco stems. The tobacco stems may be dried by the method of the invention to a level of 18 to 26 percent moisture content, mixed with other expanded tobacco forms, and the mixture dried in accordance with the present invention to a moisture level of 5 to 25 percent. The tobacco processed by the method of the invention may, according to the particular requirements, possess a moisture content when discharged of between 5 to 25 percent, preferably 10 to 16 percent. An optimum percentage has been found to reside in the neighborhood of 13 percent for best post-process handling.

In the preferred method of the invention, the volume of airflow will be sufficient to allow the desired circulatory motion in the larger chambers 18. This velocity will vary according to the density of material being dried and the density of the conveying air, which will vary with temperature and humidity. In handling these tobaccos, the temperature of the inlet air passing through conduit 10, will range between 250° F. to 650° F. The expanded tobacco itself entering conduit 10 will generally range between room temperature and 215° F. The temperature of air emanating from the last chamber 18 will generally range from 170° F. to less than 600° F. Thus, the tobacco, after initial exposure to air temperatures of 250° F. to 650° F., will then be subjected to cooler air at 170° F. to less than 600° F. After exit of the dried tobacco, it may be cooled further as desired.

The residence time of expanded tobacco in the drying step of the invention may be terminated when the desired moisture level is reached. Exact drying times may be readily ascertained by trial and error for any given expanded tobacco.

The following examples describe the manner and process of making and using the invention and set forth the best mode contemplated by the inventor of carrying out the invention, but are not to be construed as limiting.

In determining the filling power of dried tobacco products, a compressometer of the type reported by Dr. A. B. Canon at the 30th Tobacco Chemists Conference is used. The method involves equilibrating a 3-gram sample with an appropriate methanol/water mixture, placing it into a 50 ml graduated cylinder, applying a piston weight equivalent to 2.75 lbs./sq. in. and vibrating for 10 minutes. The filling capacity is reported as the volume occupied at 10 minutes per gram dry weight of sample. Experiments have shown that this apparatus will accurately determine the volume (filling capacity) of a given amount of cut tobacco with good reproducibility. The methanol/water equilibration eliminates the effect of moisture content on the filling capacity values. The pressure applied by the piston corresponds closely to the pressure normally applied by the wrapping paper to tobacco in cigarettes.

RO-TAP PSD (Particle Size Distribution) is determined by placing approximately 30 grams of a sample, which has been conditioned to near 13 percent moisture content, onto the top screen of a standard RO-TAP shaker. A stack of six screens and a pan are used: 6, 9, 10, 14, 24 and 32 mesh Tyler. The sample is tapped for 60 seconds and the percent weight retained is recorded for each screen and the pan. For purposes of the following examples, only the percent +6 mesh (large particles) and −14 mesh ("fines") are reported in the interest of clarity.

EXAMPLE 1

Apparatus, as described above in relation to FIG. 1, is provided having a nominal throughput capacity of about 5500 lbs. of bone dry tobacco per hour. Airflow is maintained through the apparatus while introducing cut tobacco (lamina blend), which has been nominally expanded by water addition, into the airflow as previously described. The thusly dried tobacco is separated and allowed to cool to room temperature. The physical properties of the starting tobacco and the dried product, together with the process conditions, are given in TABLE 1, below, under the designation of "Run A." Run A is a composite of four lots of the same blend passed through the provided apparatus under the same conditions.

For purposes of providing a control, the abovedescribed procedure is repeated, but the drying conditions are modified so as to fall outside the scope of the invention. The results and process conditions are set forth in TABLE 1, below, under the designation of "Run B."

TABLE 1

LAMINA BLEND

| | Control Run B | Run A |
|---|---|---|
| Inlet Tobacco Moisture % (at pipe 16) | 19.1 | 19.2 |
| Exit Tobacco Moisture % (at separator 28) | 15.8 | 16.7 |
| Inlet Tobacco Temperature ° F. (at pipe 16 | 96 | 99 |
| Exit Product Temperature ° F. (at separator 28) | 140 | 190 |
| Inlet Dry Bulb Temperature (° F. in Conduit 10) | 208 | 275 |
| Exit Dry Bulb Temperature (° F. in duct 30) | 163 | 233 |
| Exit Wet Bulb Temperature (° F. in duct 30) | 136 | 210 |
| Exit Absolute Humidity lb./lb. (in duct 30) | 0.13 | 15.4 |
| Air Temperature in duct 22 (° F.) | 164 | 241 |
| Tobacco Throughput (Bone Dry lb./hr.) | 5600 | 5400 |
| Calculated Tobacco Residence Time (sec.) | 7 | 7 |
| Filling Power (cc/gm) of Starting Tobacco | 5.72 | 5.77 |
| Filling Power (cc/gm) of Dried Product | 5.88 | 6.27 |
| RO-TAP PSD: % +6 Mesh (Large particles) | 40.6 | 47.1 |
| % −14 Mesh (Dust) | 14.1 | 11.9 |
| % Padded Particles | 13.3 | 7.0 |

From the above Table 1 it will be observed that the dried product of Run A shows the following improvement in percentages over the control Run B.

| | |
|---|---|
| Filling Power | 6.63% |
| RO-TAP PSD: | |
| % +6 Mesh | 16.0% |
| % −14 Mesh | 15.6% |
| percent Padded Particles | 47.4% |

EXAMPLE 2

The procedure of Example 1, supra, is repeated except that the tobacco is highly expanded tobacco stem and the resulting Runs C and D (control) are composites of eight lots of the same tobacco stems passed through the drying apparatus. The properties of the starting material, dried product and the process conditions are set forth in TABLE 2, below.

TABLE 2

STEM

| | Control Run D | Run C |
|---|---|---|
| Inlet Stem Moisture % (at pipe 16) | 44.6 | 14.5 |
| Exit Stem Moisture % (at separator 28) | 20.3 | 20.4 |
| Inlet Tobacco Temperature °F. (at pipe 16) | 199 | 199 |
| Exit Product Temperature °F. (at separator 28) | 116 | 140 |

TABLE 2-continued

STEM

| | | |
|---|---|---|
| Inlet Dry Bulb Temperature (°F. in conduit 10) | 383 | 393 |
| Exit Dry Bulb Temperature (°F. in duct 30) | 199 | 273 |
| Exit Wet Bulb Temperature (°F. in duct 30) | 133 | 205 |
| Exit Absolute Humidity lb./lb. (in duct 30) | 0.09 | 4.0 |
| Air Temperature in duct 22 (°F.) | 150 | 250 |
| Tobacco Throughput (Bone Dry lb./hr.) | 2300 | 1700 |
| Calculated Tobacco Residence Time (sec.) | 6 | 6 |
| Filling Power (cc/gm) of Starting Tobacco | 8.88 | 9.00 |
| Filling Power (cc/gm) of Dried Product | 7.98 | 8.48 |
| RO-TAP PSD: % +6 Mesh (Large particles) | 24.5 | 42.2 |
| % −14 Mesh (Dust) | 8.4 | 5.1 |

From the above Table 2 it will be observed that the dried product of Run C shows the following improvement in percentages over the control Run D.

| | |
|---|---|
| Filling Power | 6.27% |
| RO-TAP PSD: | |
| % +Mesh | 72.2% |
| % −14 Mesh | 64.7% |

EXAMPLE 3

The procedure of Example 2, supra, is repeated except that the expanded tobacco is a lamina blend using the expanded stem which has been dried to 20 percent moisture content as shown in Example 2. The properties of the starting material, dried product and the process conditions are set forth in Table 3, below. Run E, designated as representative of the process of the invention, and Run F, being a control, are composites of eight lots of tobacco passed through the drying apparatus. The inlet tobacco conditions of temperature and moisture were chosen to represent optimal conditions for both drying modes.

TABLE 3

LAMINA BLEND USING STEM

| | Control Run F | Run E |
|---|---|---|
| Inlet Blend Moisture % (at pipe 16) | 25.0 | 21.0 |
| Exit Blend Moisture % (at separator 28) | 15.5 | 16.0 |
| Inlet Tobacco Temperature ° F. (at pipe 16) | 204 | 84 |
| Exit Product Temperature ° F. (at separator 28) | 148 | 188 |
| Inlet Dry Bulb Temperature (° F. in conduit 10) | 265 | 307 |
| Exit Dry Bulb Temperature (° F. in duct 30) | 180 | 231 |
| Exit Wet Bulb Temperature (° F. in duct 30) | 138 | 206 |
| Exit Absolute Humidity lb./lb. (in duct 30) | 0.13 | 4.9 |
| Air Temperature in duct 22 (° F.) | 166 | 229 |
| Tobacco Throughput (Bone Dry lb./hr.) | 10,600 | 10,600 |
| Calculated Tobacco Residence Time (sec.) | 7 | 7 |
| Filling Power (cc/gm) of Starting Tobacco | 6.45 | 6.39 |
| Filling Power (cc/gm) of Dried Product | 6.21 | 6.62 |
| RO-TAP PSD : % + 6 Mesh (Large particles) | 41.4 | 52.7 |
| % − 14 Mesh (Dust) | 14.6 | 11.1 |
| % Padded Particles | 16.0 | 10.3 |

From the above Table 3 it will be observed that the dried product of Run E shows the following improvement in percentages over the control Run F.

| | |
|---|---|
| Filling Power | 6.60 |
| RO-TAP PSD: | |
| % +Mesh | 27.3% |
| % −14 Mesh | 31.5% |
| Percent Padded Particles | 35.6% |

Similarly, repeating the above general procedure with cut green tobacco, similar improvements are observed.

EXAMPLE 4

A quantity of highly expanded and cut tobacco stem is divided into several portions. The tobacco has a moisture content of 41 percent by weight. The tobacco portions are dried by entrainment in air heated to a temperature of about 500° F. Each portion is dried to a moisture content of about 13 percent by weight, in the presence of varying absolute humidity as determined with a wet-bulb thermometer. The dried tobacco portions are then tested for filling power. The varying humidities used and the filling powers obtained are shown in TABLE 4, below.

TABLE 4

| Portion | Wet Bulb Temp. (°F.) | Absolute Humidity (Lb. Water/Lb.Air) | % Water Vapor | Filling Power (cc/gm) |
|---|---|---|---|---|
| 1 | 126 | 0.065 | 6 | 8.04 |
| 2 | 150 | 0.178 | 15 | 8.04 |
| 3 | 164 | 0.301 | 23 | 8.21 |
| 4 | 179 | 0.575 | 37 | 8.37 |
| 5 | 193 | 1.25 | 56 | 8.69 |
| 6 | 193 | 1.23 | 55 | 8.99 |
| 7 | 202 | 2.67 | 73 | 9.19 |

Figure 2:
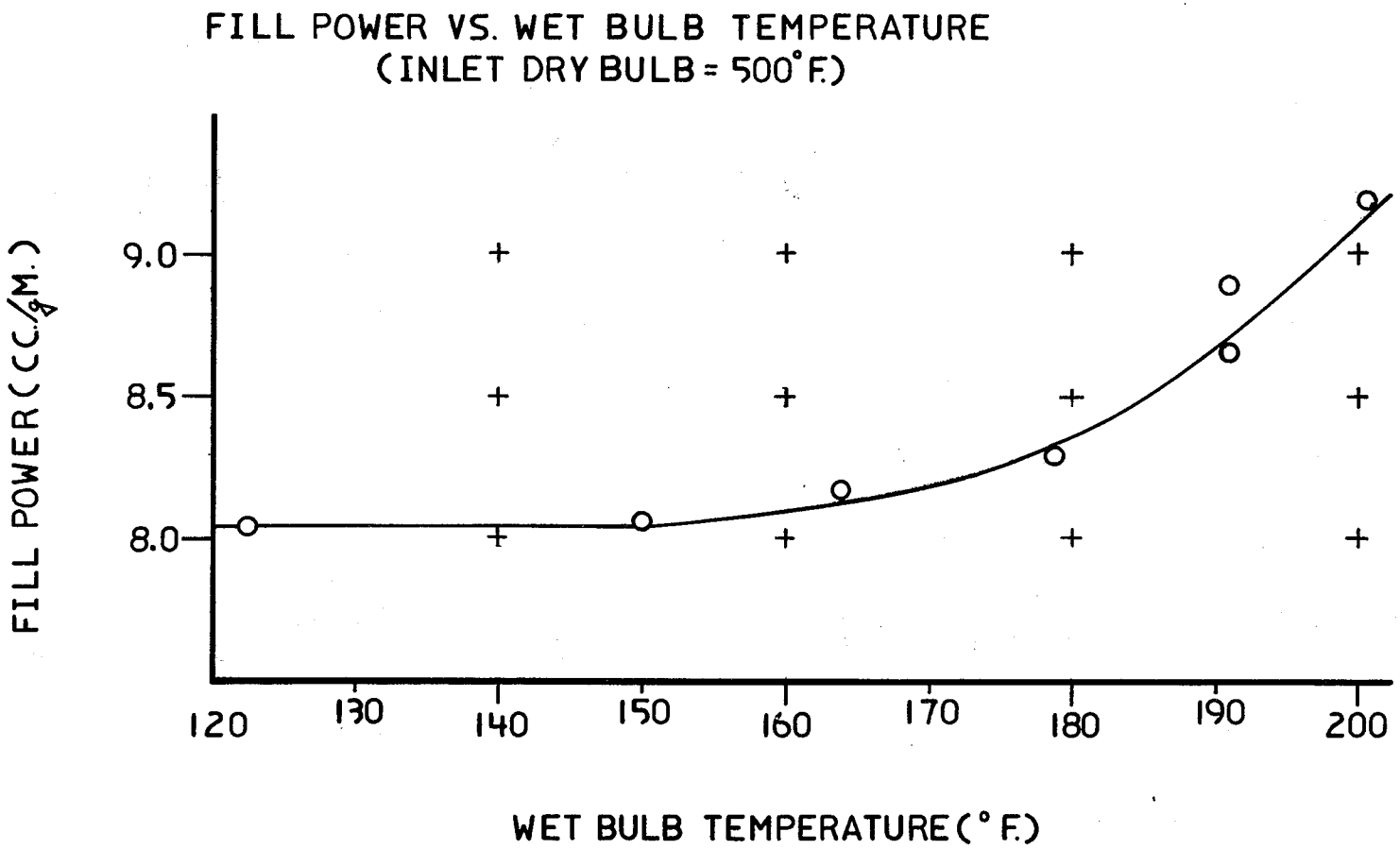
FIG. 2 is a graph depicting the filling power of tobacco dried under varying absolute humidity conditions.

The information of TABLE 4 is graphically depicted in FIG. 2. With reference to FIG. 2, one may appreciate the improvement in filling power as the absolute humidity is increased. There is a significant improvement in filling power when the wet-bulb temperature exceeds about 150° F.

Figure 3:
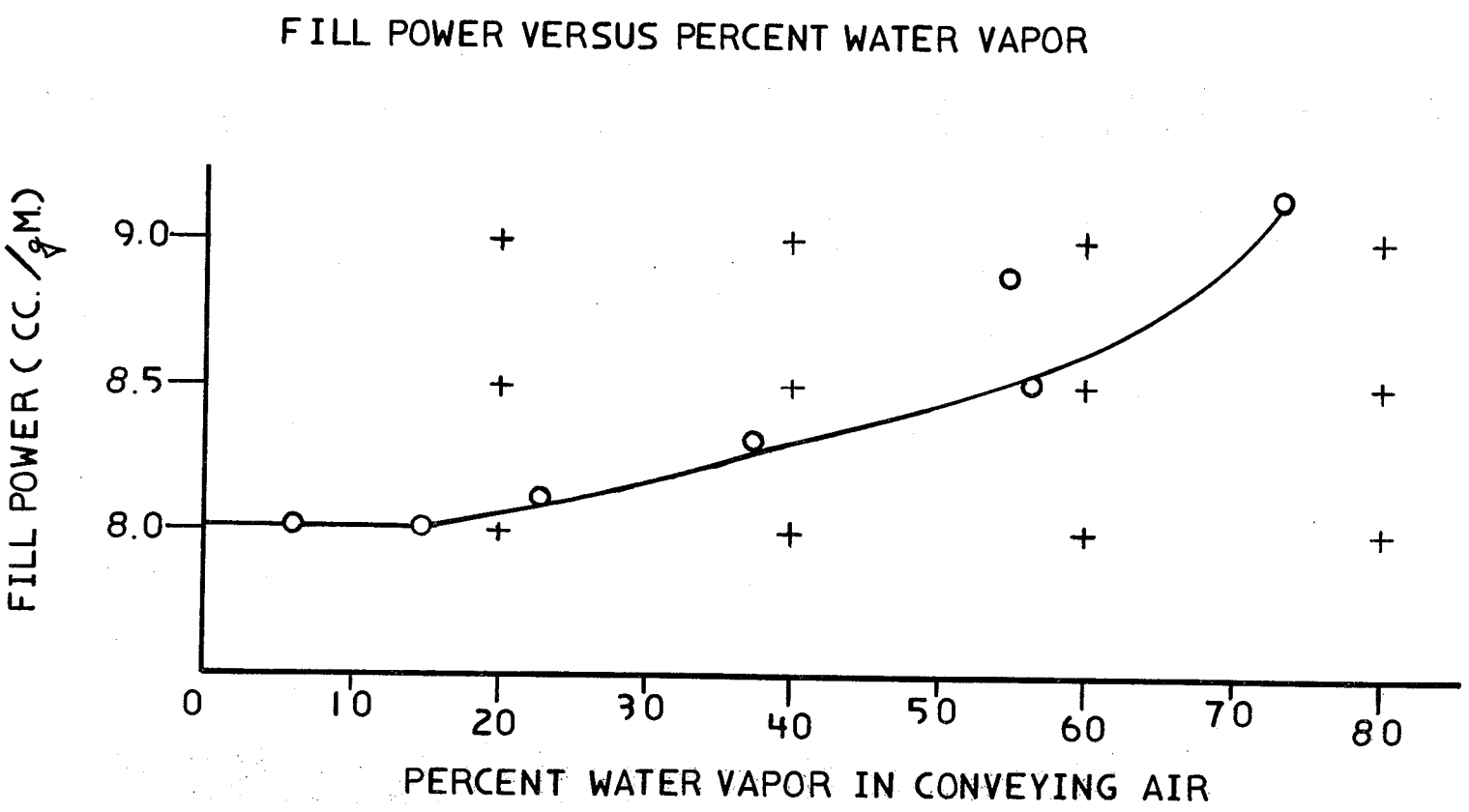
FIG. 3 is a graph depicting the percent water vapor in the drying air described in FIG. 2, measured against the filling power of the dried tobacco.

From the data of TABLE 4, one can graphically depict the percentage of water vapor in the conveying air for each of the tobacco portions dried in Example 4. These percentages are shown in FIG. 3 and show the significant improvement of filling power under high humidity drying conditions.

Those skilled in the art will appreciate that many modifications of the above-described preferred process of the invention may be made without departing from the spirit and the scope of the invention. For example, although the drying means described in the preferred embodiment is air heated to the appropriate temperature, any gaseous medium which will not adversely effect the tobacco may be used, such as nitrogen gas, carbon dioxide gas, super-heated steam and the like. Also any dryer means, such as a fluidized bed dryer, rotary dryer, tunnel dryer and like dryers, may be used.

We claim:

1. A method of reducing the moisture content of an expanded tobacco, which comprises:

heating the expanded tobacco in a gas, said gas having an initial temperature within the range of from about 250° F. to about 650° F., in the presence of an absolute humidity at a level above that which will provide a wet-bulb temperature reading of at least about 150° F.

2. The method of claim 1 wherein said temperature is about 500° F. and said reading is at least about 180° F.

3. The method of claim 1 wherein the heated tobacco is then subjected to cooler gas at a temperature of from 170° F. to 600° F.

4. The method of claim 3 wherein said cooler gas temperature is about 275° F. and said reading is circa 210° F.

5. The method of claim 1 wherein said temperature is about 500° F. and said reading is at least about 205° F.

6. The method of claim 1 wherein said temperature is about 275° F. and said reading is circa 205° F.

7. The method of claim 1 wherein said tobacco is tobacco lamina.

8. The method of claim 1 wherein said tobacco is tobacco stem.

9. The method of claim 1 wherein said tobacco is reconstituted tobacco.

10. The method of claim 1 wherein said tobacco is a blend of tobacco lamina, reconstituted tobacco and stem.

11. The method of claim 1 wherein said temperature is circa 500° F.

12. The method of claim 1 wherein the expanded tobacco to be dried has a moisture content of from 18 to 90 percent by weight.

13. The method of claim 1 wherein said gas is air.

14. The method of claim 1 wherein said gas is superheated steam.

15. The method of claim 1 wherein said reading is circa 205° F. to 210° F.

16. The method of claim 1 wherein the expanded tobacco to be dried has a temperature of from ambient to 215° F.

17. The method of claim 1 wherein the tobacco is dried to a moisture content of from 5 to 25 percent by weight.

18. The method of claim 17 wherein said percent is from 10 to 16.

19. The method of claim 1 wherein expanded stem is dried to between 18–26 percent moisture content, added to expanded lamina to create a blend and subjected to the method of claim 1 and dried to a moisture of 5–25 percent.

20. The method of claim 1 wherein the tobacco is harvested green tobacco in its fully expanded state.

21. The method of claim 1 wherein lamina is dried to a moisture content of from 5–25 percent;

stem is dried to a moisture content of from 5–25 percent; and the dried lamina and stem are blended together.

* * * * *